United States Patent [19]

Feldmann et al.

[11] Patent Number: 4,901,646

[45] Date of Patent: Feb. 20, 1990

[54] FIN-STABILIZED SUBCALIBER PROJECTILE

[75] Inventors: Fritz K. Feldmann; Paul J. Griffith; Craig L. Christenson, all of Santa Barbara, Calif.

[73] Assignee: Pacific Armatechnica Corporation, Santa Barbara, Calif.

[21] Appl. No.: 328,859

[22] Filed: Mar. 27, 1989

Related U.S. Application Data

[62] Division of Ser. No. 75,818, Jul. 20, 1987, Pat. No. 4,815,682.

[51] Int. Cl.[4] ..... F42B 13/16

[52] U.S. Cl. ..... 102/521; 102/523

[58] Field of Search ..... 102/520–523, 102/703

[56] References Cited

U.S. PATENT DOCUMENTS

| | | | |
|---|---|---|---|
| 3,738,279 | 6/1973 | Eyre et al. | 102/521 |
| 4,187,783 | 2/1980 | Campoli et al. | 102/520 |
| 4,517,899 | 5/1985 | Häberli | 102/521 |
| 4,733,612 | 3/1988 | Sigg | 102/521 |

*Primary Examiner*—Charles T. Jordan

*Assistant Examiner*—Michael J. Carone

*Attorney, Agent, or Firm*—Patrick J. Walsh

[57] ABSTRACT

The invention concerns a fin-stabilized discarding sabot projectile for employment from a rifled barrel and is particularly suitable for automatic cannons having calibers from 12.7 to 70 millimeters. The full rate of spin commensurate with the rifling twist of a specific barrel and the muzzle velocity is imparted to the projectile during launch using a rotating band which is fixed and an integral component of the discarding sabot. The discarding sabot design involves the in-place injection molding of the sabot body, including a seal with obturator, onto the fin-stabilized projectile. The absence of slipping rotating band provides for a rugged sabot configuration which is particularly important for ammunition employed from automatic cannons. Launching at full rate of spin results in large centrifugal forces acting on the components of the sabot which provides for instantaneous and precise sabot separation upon projectile exit from the muzzle. This combined with the highly repeatable and reliable tuning of the projectile spin rate permits excellent projectile accuracy and dispersion characteristics.

4 Claims, 3 Drawing Sheets

FIN-STABILIZED SUBCALIBER PROJECTILE

This is a division of application Ser. No. 075,818, filed Jul. 20, 1987, now U.S. Pat. No. 4,815,682 dated Mar. 28, 1989.

BACKGROUND OF THE INVENTION

In contrast to conventional spin-stabilized projectiles which derive their in-flight stability from the gyroscopic forces resulting from the high rate of spin, the finned projectiles are stabilized during flight by aerodynamic forces acting on the projectile. Although projectile spin does not contribute to the stabilization of finned projectiles, a low rate of roll around the longitudinal axis is desired to minimize the adverse effects of mass and configurational asymmetries which may result from material imperfections and from manufacturing tolerances.

Fin-stabilized projectiles are ideally launched from smooth bore guns which, due to the absence of rifling, do not impart a rolling motion. Such weapons are installed, for instance, on advanced battle tanks and commonly have calibers of 60 millimeters or more.

Automatic cannons having calibers ranging approximately from 12.7 to 40 millimeters have almost exclusively rifled barrels and generally fire various types of spin-stabilized projectiles, including armor-piercing projectiles. In order to improve the armor penetration of such weapons, it is desirable to develop technology permitting successful employment from rifled gun barrels of fin-stabilized armor-piercing projectiles with their inherent high degree of terminal effectiveness. In this case, successful employment means compatibility of the ammunition with the gun and feeder system, which in turn requires the necessary structural integrity to function reliably under all operating conditions specified for such weapons while at the same time providing a projectile accuracy which is equal to or better than that of spin-stabilized projectiles fired from the same weapon.

Commonly, fin-stabilized projectiles consist of a subcaliber penetrator and a fin assembly of four or more fins attached to the rear of the penetrator. The projectile assembly is symmetric to its longitudinal axis and is fired from the gun by means of a discarding sabot. Two important functions of the discarding sabot are to support and guide the subcaliber projectile along the centerline of the gun barrel during acceleration and to form a seal to contain the propellant gasses during travel in the barrel. The latter function is accomplished by the rotating band which engages the rifling grooves of the gun barrel and in doing so imparts spin to the projectile commensurate with the rifling twist of the barrel and the projectile muzzle velocity.

Fin-stabilized projectiles reflecting the current state of the art incorporate a sliding seat between the rotating band and the sabot body. The sliding seat is designed such as to reduce by approximately 70 to 90 percent the amount of spin transmitted from the rotating band, which picks up the full spin, to the sabot body. The degree of spin transmission within the seat of the rotating band is determined by sliding friction. Thus, upon exit from the muzzle of the gun the fin-stabilized projectile has a rate of spin equal to approximately 10 to 30 percent of that of a spin-stabilized projectile launched at the same muzzle velocity.

There are two problem areas encountered with this method of firing fin-stabilized projectiles from a rifled cannon. Firstly, it is difficult to control the spin reduction in the sliding seat with a degree of repeatability necessary to assure acceptable projectile accuracy over the entire range of operating conditions specified for military employment. Variations in projectile temperature from −40° to +60° C., changes in humidity, finite manufacturing tolerances, contamination by dust, salt and other substances entering between the rotating band and its seat, etc., influence the friction coefficient in the band seat and with it the degree of spin transmission.

Secondly, centrifugal forces acting on sabot components are very effective in initiating the instantaneous and symmetric separation of the sabot from the penetrator upon exit from the muzzle of the gun. With reduced projectile spin the centrifugal forces acting on the sabot components are reduced by the square of the spin ratio. As a result, the sabot separation is neither as rapid nor as precise as with a nonslipping rotating band and is increasingly more dependent on aerodynamic forces.

The access of aerodynamic forces to the projectile is delayed by the efflux of high velocity propellant gasses upon exit of the projectile from the muzzle of the gun. These propellant gasses envelop the projectile temporarily in a reverse flow field. Only upon entering into the ambient air, which occurs at a range of approximately 30 calibers from the muzzle, do the aerodynamic forces become fully effective in sabot separation. The magnitude of the aerodynamic forces prevailing for sabot separation is only a fraction of the centrifugal forces available when launching at full spin and therefore a considerably more fragile sabot construction is required to assure its fracture and separation. In addition, because of size limitations of ammunition of calibers up to 40 millimeters, the physical dimensions of sliding rotating bands, inclusive of their seats, are small, thus resulting in rather delicate and vulnerable components. In contrast, utilization of a nonslipping rotating band allows for the use of a stronger sabot which is advantageous when employed from high rate of fire cannons and their correspondingly high structural loads during feeding and ramming.

Fin-stabilized projectiles equipped with discarding sabots incorporating slipping rotating bands experience considerable variations in spin rate at exit from the muzzle due to deviations in the friction coefficient within the sliding seat of the band. As a result the subsequent acceleration or deceleration of the projectile spin may result in conditions where the spin rate is equal to the nutation frequency of the projectile and resonance instability will occur. The lower projectile spin rate at muzzle exit and consequent reduction in centrifugal forces acting on the sabot decrease the rapidity and symmetry of the discard of the sabot components and therewith result in increased projectile dispersion.

In summary, the shortcomings encountered with discarding sabot fin-stabilized projectiles for automatic guns having spin reducing sliding rotating bands are:

1. Considerable variations in projectile spin at launch due to deviations of the friction coefficient in the sliding rotating band seat.

2. Fluctuations in projectile spin at launch which results in reduced repeatability of sabot separation and subsequent projectile trajectory, thus increasing projectile dispersion and degrading first round hit probability.

3. Reduction of projectile spin at launch which decreases the centrifugal forces desired for sabot separation, thus demanding a weaker sabot construction. The loss of ruggedness and reliability is further aggravated by the vulnerability of the sliding rotating band and its seat.

Proponents of the use of sliding rotating bands erroneously assume the existence of high aerodynamic drag forces during aerodynamic despinning of projectiles having full spin rate at launch. Firing tests have demonstrated that such induced drag is minimal at most which is not surprising considering that the rotational energy of typical subcaliber fin-stabilized projectiles is less than one percent of their translatory kinetic energy. In this connection it is also of interest that because of the precise and symmetric sabot separation of the fully spun up fin-stabilized projectile, the maximum projectile yaw measured at launch was found to be less than five degrees. This low level of initial yaw is highly desirable to minimize aerodynamic drag and projectile retardation.

SUMMARY OF THE INVENTION

The object of the present invention is to improve the hitting accuracy of fin-stabilized, subcaliber projectiles fired from rifled gun barrels by defining the projectile characteristics which enable launch at the full rate of spin i.e., without the use of spin-reducing rotating bands. Furthermore, the elimination of the rather fragile sliding rotating band will increase the structural integrity and reliability of the ammunition.

The invention is primarily directed towards fin-stabilized projectiles developed for automatic cannons having calibers ranging from 12.7 to 40 millimeters. A discarding sabot equipped with a fixed rotating band will spin up during acceleration in the gun barrel in accordance with the rifling twist of the barrel, and the resultant spin at launch is dependent on muzzle velocity only and is therefore highly repeatable. This spinning motion is transmitted without reduction to the subcaliber projectile. Subsequent to its exit from the gun and the ensuing sabot separation, the subcaliber projectile enters ambient atmosphere and is subject to aerodynamic forces. In addition to stabilizing the projectile in-flight, aerodynamic forces acting on the fins induce a rapid deceleration of the projectile spin rate. After a comparatively short time of flight the spin rate approaches a steady state value. This steady state spin rate is predetermined by the cant angle of the fins and furthermore is proportional to the projectile flight velocity. In order to maintain stable flight conditions and to avoid trajectory deviation it is imperative that the steady state spin rate of the projectile be always larger than its natural or nutation frequency. Such selection of the steady state spin rate will prevent the occurrence of resonance instability which may give rise to large angles of attack or even catastrophic yaw. The critical spin rate (nutation frequency) of the projectile is determined by its moments of inertia and its aerodynamic characteristics and represents a fixed value for a given projectile configuration. Within limits the magnitude of the critical spin rate can be influenced by projectile design.

The fin-stabilized projectile is provided with a discarding sabot comprising three major components including a sabot base, a sabot body, and a protective cap. The sabot base is preferably a lightweight material such as aluminum formed in three or more equal elements engaging the penetrator midway along its length in coaxial position with respect to the base of a gun barrel. The base transfers the longitudinal accelerating force and the torque induced by the rifling twist from the sabot to the penetrator. A plastic sabot body, is positioned forward of the sabot base and is provided with an integral rotating band for engaging the rifling grooves serving both as an obturator and to transmit the spinning motion induced by the rifling twist to the penetrator. The sabot body further includes three or more longitudinal grooves extending radially from its exterior cylindrical surface leaving a web of finite thickness at the inner boundary of the groove. The sabot will fracture along the longitudinal grooves under centrifugal force upon exit from the muzzle of the cannon.

In an important aspect of the sabot design there is provided a mechanical interlock between the sabot body and the sabot base which anchors the frontal portion of the base and the rear of the sabot body. The interlock prevents separation of the two components due to propellant gas force acting on the rear of the rotating band during launch. Additionally, the interlock transfers spin from the sabot body to the sabot base.

In another important aspect of the present invention, the interfaces between sabot base elements are sealed and the juncture of the rear face of the sabot base and the penetrator is provided with a ring-shaped obturator. The base element seal, the ring-shaped obturator, and the sabot body are a single integral unit preferably consisting of a fibre reinforced plastic. Because of the configurational complexity of the sabot body and its intergral seals it is preferably injection molded onto the preassembled penetrator-sabot base unit.

A protective cap is fitted to the forward end of the sabot body for protection of the forward portion of the penetrator and for adaptation of the projectile to automatic feed systems.

Subsequent to sabot separation the aerodynamically induced deceleration of the projectile spin rate to the steady state spin rate is rapid, precise and very repeatable. This, combined with the fact that the initial spin rate at muzzle exit is as tightly controlled as the projectile muzzle velocity, commonly to a standard deviation of not more than one percent, results in a very repeatable and precise projectile spin history over its trajectory.

The full spin obtained with a fixed, nonslipping rotating band yields the high centrifugal forces acting on the sabot components desired for their instantaneous and symmetric radial separation upon exit of the projectile from the muzzle. This method of sabot separation, combined with the controlled projectile spin decay along its subsequent trajectory as obtainable with projectiles having fixed rotating bands, results in projectile accuracies not achievable with the current state of the art.

OBJECTS OF THE INVENTION

It is an object of the invention to provide a fin-stabilized discarding sabot projectile fired from a rifled barrel at the full spin rate commensurate with the rifling twist of the barrel.

Another object of the invention is to provide a fin-stabilized discarding sabot projectile at full spin rate from the rifled barrel thereafter decelerating to a steady state spin rate in a rapid, precise, and very repeatable manner by aerodynamic damping resulting in a very repeatable and precise spin history over the full trajectory of the projectile.

Another object of the invention is to provide a fin-stabilized discarding sabot projectile fired from a rifled barrel developing full spin rate during launch and having a steady state spin rate greater than the nutation frequency of the projectile.

Another object of the invention is to provide a fin-stabilized discarding sabot projectile fired at full spin rate from a rifled barrel and having a spin half-life of not more than 0.1 seconds, the spin half-life being time required to reduce the projectile spin rate to a value halfway between its initial value at launch and its steady state spin rate.

Another object of the invention is to provide a fin-stabilized projectile including a robust discarding sabot having instantaneous and symmetrical radial separation after launch resulting from the centrifugal forces induced by the full projectile spin.

Another object of the invention is to provide a discarding sabot for a fin-stabilized projectile in which the sabot included three essential elements: a sabot base, a plastic sabot body including an integral rotating band and seals, and a protective cap.

Another object of the invention is to provide a discarding sabot for a fin-stabilized projectile in which the sabot base and plastic sabot body have a mechanical interlock and in which the sabot body includes an integral plastic rotating band for obturating gun gasses and transferring the full spin to the projectile as induced by the rifling twist of the barrel.

Another object of the invention is to provide a discarding sabot for a fin-stabilized projectile in which the sabot body includes an integral rotating band providing for obturation of gun gasses at the rifling grooves furthermore including a seal extending through the interfaces of the sabot base elements, and lastly providing an obturator at the interface of sabot base and penetrator.

Another object of the invention is to provide a discarding sabot for a fin-stabilized projectile having an integral construction of sabot body, rotating band, sealing elements and base obturator.

Another object of the invention is to provide a sabot body for a fin-stabilized subcaliber projectile which may be injection molded directly to a preassembly of penetrator and sabot base elements.

These and other objects will become more readily apparent from the following detailed description of the invention.

BRIEF DESCRIPTION OF THE DRAWINGS

Details of the invention will be described with reference to an illustrative embodiment shown in the following drawings.

DETAILED DESCRIPTION OF PREFERRED EMBODIMENT

Figure 1:
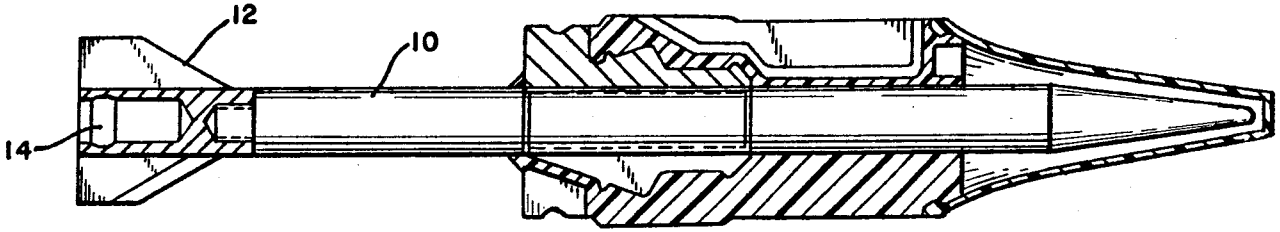
FIG. 1 is a longitudinal cross section of a fin-stabilized subcaliber projectile-discarding sabot assembly.

A longitudinal cross section of the subcaliber projectile contained within the discarding sabot assembly is shown in FIG. 1. The subcaliber projectile consists of the penetrator 10 and the fin assembly 12 at its rear. For most applications a pyrotechnic tracer 14 is provided which is commonly installed within the central body of the fin assembly. In order to achieve a high penetration efficiency, a high density metal such as tungsten alloy or depleted uranium alloy is preferably used for the penetrator 10. Either steel or aluminum is used for the manufacture of the fin assembly 12. In the case of a high velocity projectile, aluminum fins will require a protective coating to prevent burning due to aerodynamic heating.

Figure 2:
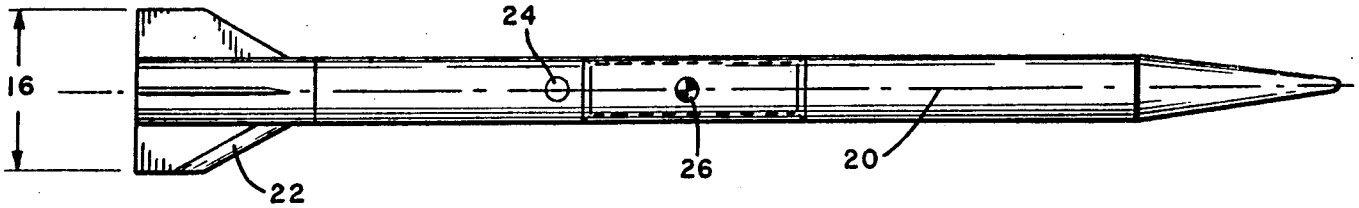
FIG. 2 is a longitudinal view of a fin-stabilized subcaliber projectile.

Commonly, the fin assembly consists of 4 to 6 fins arranged symmetrically around the central body. A four fin assembly is shown in FIG. 2. Because of gun constraints the maximum fin span 16 has to be equal to or less than the bore diameter of the gun. In order to reduce aerodynamic drag, the leading edge of the fin is swept back and the thickness of the fin is small. The planform of the fins has to be sufficient to yield longitudinal aerodynamic stability for the subcaliber projectile with a stability margin of not less than 1.2 subcaliber projectile diameters where the stability margin is defined as the rearward location of the aerodynamic center of pressure 24 with regards to the center of mass 26 of the projectile.

In accordance with this invention, the fin assembly, furthermore, has to create an aerodynamic rolling moment with regards to the longitudinal axis 20 of the subcaliber projectile to produce a steady state spin rate during flight similar to the windmilling of a propeller. The rolling moment is induced aerodynamically, either by an angle of incidence of the fins similar to a stabilizer on an aircraft or a canted leading edge 22 of the fins as shown in FIG. 2 or canted trailing edges of the fins. It is preferable that all fins be shaped identically.

It is a general object of this invention that the subcaliber projectile be imparted the full rate of spin in accordance with the rifling twist and the muzzle velocity of the gun barrel. This requires that the discarding sabot incorporate a fixed rotating band which transfers the torque induced by the rifling to the subcaliber projectile contained therein without slippage. Upon exit from the muzzle and sabot separation, the subcaliber projectile enters the ambient atmosphere and is immediately subjected to spin reducing aerodynamic damping in roll. The rapid spin deceleration continues until the steady state spin rate commensurate with the fin configuration and projectile velocity has been reached. The spin half life, which is the time required to reduce the projectile spin rate to a value halfway between its initial value at launch and its steady state spin rate, should be between 0.04 and 0.07 seconds, and not more than 0.1 seconds. During this phase the projectile is dynamically stable and undergoing increasing dynamic stability and its spin half life of not more than 0.1 seconds is too short to permit potential adverse amplification of its precession due to Magnus moment disturbance.

Figure 3:
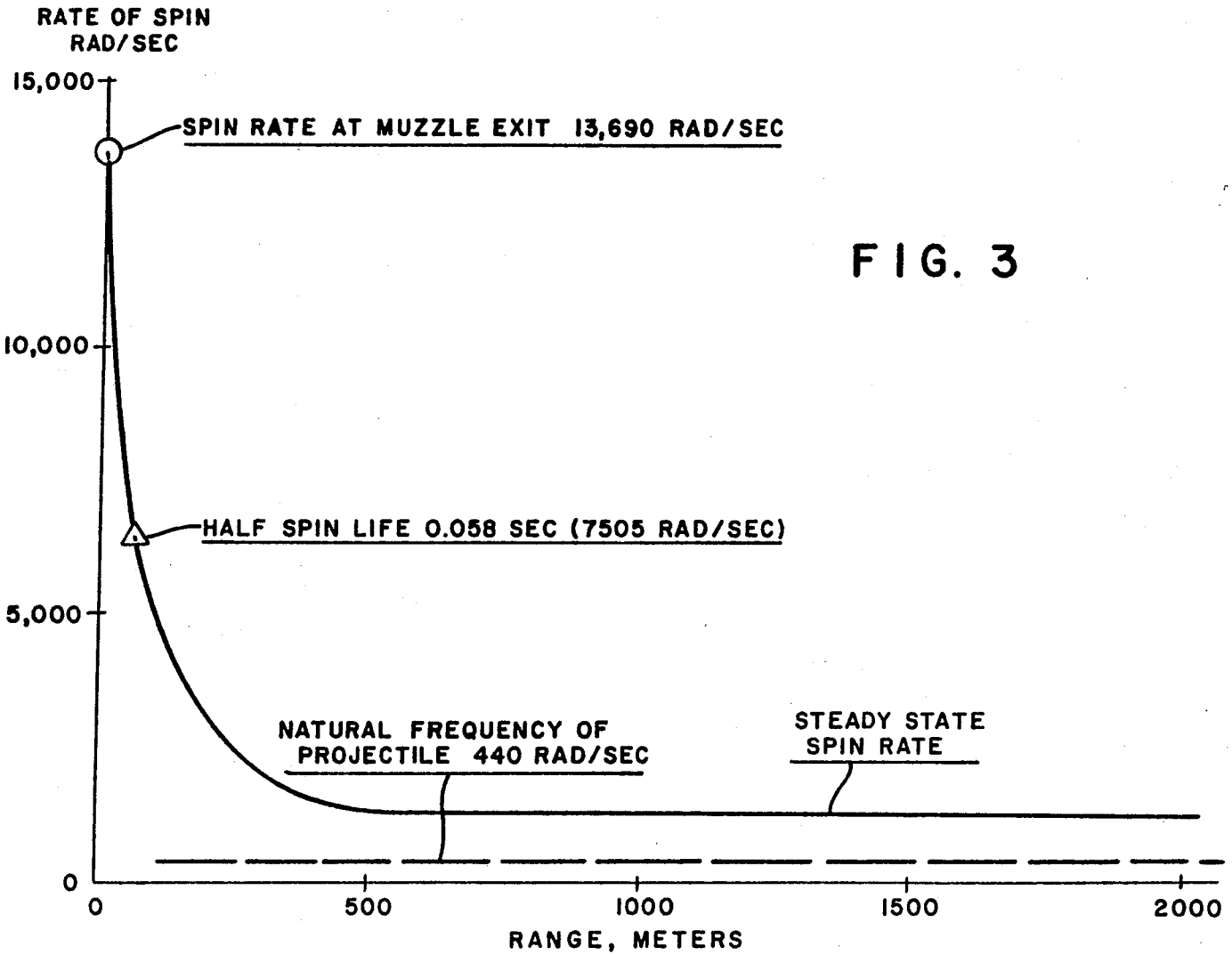
FIG. 3 is a diagram presenting the spin rate of a fin-stabilized projectile as a function of range.

It is an important aspect of this invention to define the steady state spin rate of the subcaliber projectile such as to prevent the occurrence of resonance instability and related resonance jump over the operational range of the projectile. Spinning fin-stabilized projectiles are subject to a resonance instability which is defined as the condition where the projectile rate of spin is equal to the natural (or nutation) frequency of the projectile. It is characterized by an amplification of the non-rolling trim angle of attack resulting from configurational asymmetrics such as may result from machining tolerances and/or material imperfections. The nutation frequency $\omega_1$ of the fin-stabilized projectile is determined using the tricyclic theory of motion in accordance with the following equation:

$$\text{Nutation frequency } \omega_1 = \frac{p}{2}\ \frac{I_A}{I_T}\left(1+\frac{1}{t}\right);\ t=\frac{1}{1-\frac{1}{s}}$$

where:
p=projectile spin rate
$I_A$=axial moment of inertia
$I_T$=transverse moment of inertia
s=gyroscopic stability factor Resonance instability gives rise to large angles of attack and consequently leads to unacceptable projectile dispersion. In addition, resonance may be accomplished by roll lock-in and catastrophic yaw. In order to avoid the occurrence of resonance instability, the steady state spin rate has to be different from the nutation frequency of the projectile. It is an object of this invention that the projectile spin rate be decelerated rapidly from its value at launch to a steady state spin rate which exceeds the nutation frequency of the projectile by at least 50 percent under all conditions within the operational range specified for the ammunition. The process, also referred to as spin tuning, is further described in an example thereof as illustrated in FIG. 3. The presentation shows the projectile spin rate as a function of range for a fin-stabilized projectile fired from a 25 mm automatic cannon having a rifling twist at exit of 7.5 degrees. At a muzzle velocity of 1300 m/sec the corresponding spin rate at launch is 13,690 rad/sec. Subsequent to sabot separation the projectile spin rate decelerates rapidly as a result of aerodynamic damping in roll. The half spin life (7505 rad/sec) is attained after 0.058 seconds which in accordance with a projectile velocity of 1300 m/sec corresponds to a range of 75 meters from the gun. At approximately 500 meters from the gun the projectile has reached its steady state spin rate of 1320 rad/sec. This rate will further decrease proportionally to the projectile velocity. At a horizontal range of 2000 meters the remaining projectile velocity is 1020 m/sec and the steady state spin rate is 1106 rad/sec. The natural frequency of the projectile has been calculated at 440 rad/sec. Thus, at the maximum operational range of the projectile its steady state spin rate is still more than a factor of 2.5 larger than its nutation frequency and therefore resonance instability is avoided. The data presented above are based on firing data and prove the validity of spin tuning which is an object of this invention.

An important aspect of the present invention is the discarding sabot for the fin-stabilized subcaliber projectile. In its preferred embodiment the discarding sabot consists of three major components as illustrated in a longitudinal section presented in FIG. 4. The rearwardmost component is the sabot base 28 consisting of three or more equal elements 29 which contain the penetrator 10 of the subcaliber projectile in a coaxial position. The three elements interface with each other along radially extending planar surfaces 30. The arrangement of the sabot base elements is also shown in FIG. 5 which is a rear view of the discarding sabot. The interface 32 of the sabot basewith the centrally located penetrator serves several important functions. Firstly, it locates the penetrator in a coaxial position with regard to the bore of the gun barrel. Secondly, the interface has to be of sufficient strength to transfer the longitudinal accelerating force from the discarding sabot base 28 to the projectile during launch. Thirdly, the interface transmits without slippage the torque induced by the rifling twist of the gun barrel from the sabot to the penetrator. The functions described above are preferably accomplished by means of a threaded interface 32 or a series of annular grooves.

Figure 4:
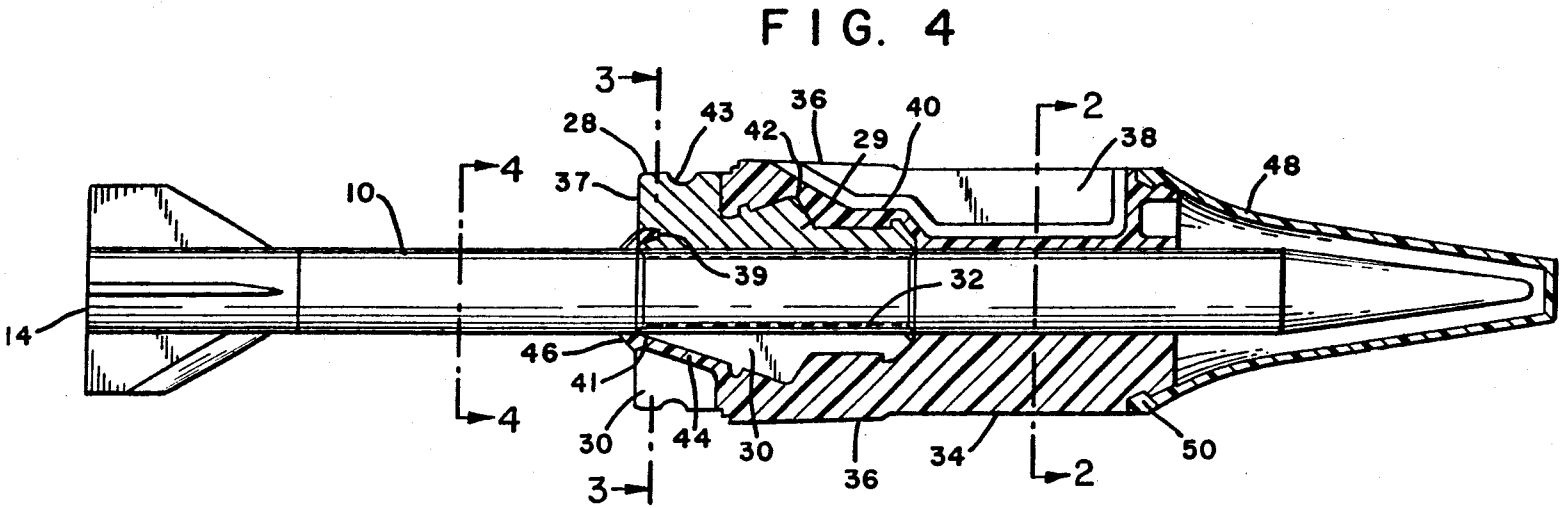
FIG. 4 is a longitudinal cross section of the fin-stabilized subcaliber projectile-discarding sabot assembly.
Figure 6:
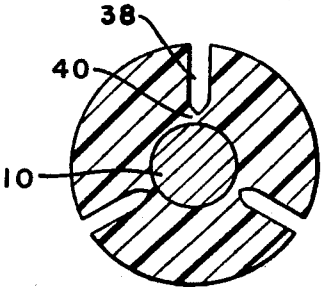
FIG. 6 is a cross section through the sabot body and subcaliber projectile along the line 2—2 of FIG. 4.
Figure 5:
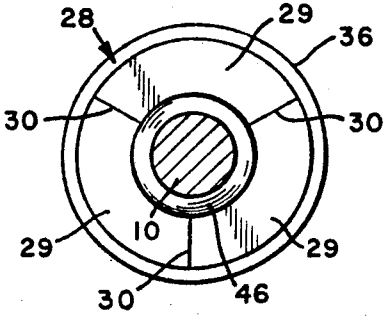
FIG. 5 is a cross section through the subcaliber projectile assembly along the line 4—4 of FIG. 4.

A further component of the discarding sabot is the plastic sabot body 34 located forward of the sabot base 28 as shown in FIG. 4. The sabot body incorporates the integral rotating band 36 which during firing engages the rifling grooves, serving both as an obturator to seal off the propellant gasses and to transmit the spinning motion induced by the rifling of the gun to the subcaliber projectile. The sabot body 34 has three or more longitudinal grooves 38 which extend radially from its exterior cylindrical surface toward the penetrator 10 and the sabot base 28 in such a fashion as to leave a web 40 of finite thickness at the interior boundary of the groove. These longitudinal grooves are shown in FIGS. 4 and 6. Upon exit from the muzzle of the cannon, fracture of the sabot body will occur immediately along the webs as a result of the centrifugal forces due to the high rate of spin. The presence of the webs will also provide a seal against entry of water and other adverse environmental conditions during storage and handling of the ammunition.

There are two critical design features which are essential for successful operation of the sabot body 34. The first concerns the configurational interlock at the common interface 42 between the frontal portion of the sabot base and the rear of the sabot body 34 see FIG. 4. This mechanical interlock is needed to anchor the sabot body to the sabot base, thus preventing a separation of the two components due to propellant gas force acting on the rear of the rotating band 36 during firing, as well as to transfer spin from the sabot body to the sabot base. The interlock configuration is designed such as to increase the effectiveness of the gas seal between the sabot body 34 and the sabot base 28 during compression of the rotating band in the barrel during firing. The interlock configuration is defined by the exterior contour of the forward two-thirds of the base surface ahead of a crimping groove 43 and generally underlying the rotating band portion of the sabot body. During projectile launch the rotating band and sabot body are compressed establishing an effective gas seal along the interface preventing migration of propellant gasses into the interface. Additionally, the sabot body transmits spin induced by the rifling grooves to the penetrator through the sabot base without slippage at the mechanical interlock surface.

Figure 7:
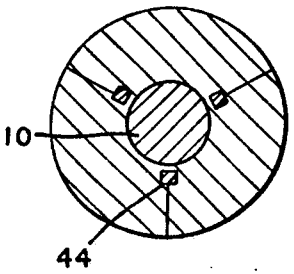
FIG. 7 is a cross section through sabot base and subcaliber projectile along line 3—3 shown in FIG. 4.

The second critical design feature is a seal 44 extending rearward through channels 41 provided within the interfaces of the sabot base segments. At the rear of the sabot base 28 the seal extending through the channels merges into a ring shaped annular obturator 46 located at the aft face 37 of the sabot base 28 and surrounding the penetrator 10. The aft face also includes a circular groove 39 for anchoring the ring obturator 46. The seal 44 is also evident in FIG. 7 showing cross section of the sabot base 28. This seal is mandatory to prevent any propellant gasses from entering into the sabot assembly during firing either through the interfaces 30 of the sabot base segments or along the circumference of the penetrator 10. The seal 44, including its obturator 46 and the sabot body, are a single integral unit which, because of its configurational complexity, is injection molded in a single operation onto the preassembled penetrator-sabot base unit. This in-place injection molding of the sabot body requires a special mold into which the projectile-sabot base subassembly is installed and centered to assure the coaxial alignment of all components.

The cross section of the seal 44 and the related channels within the interface 30 of the sabot segments 28 can be larger than shown in FIG. 4. However, it is necessary that the sabot body 34, the seal 44 and the obturator 46 constitute a single unit. Preferably a carbon or glass fibre reinforced plastic, such as nylon or liquid crystal polymers (LCP), be used for the in-place injection molding of the sabot body-seal-obturator unit.

The third major component of the discarding sabot is the protective cap 48 installed at the forward end of the sabot body. The exterior shape has to conform to the gun-ammunition interface requirements. The cap is needed to protect the subcaliber projectile portion extending beyond the forward end of the sabot body during storage, handling and feeding in the cannon. To reduce its weight the cap is hollow with thin walls and is preferably manufactured of a plastic by injection molding. The cap is preferably attached to the sabot body by means of a snap fit 50.

We claim:

1. A projectile comprising a fin-stabilized subcaliber penetrator and a discarding sabot for firing the projectile from a rifled barrel, the sabot including a segmented metallic base with a plurality of interfaces and a longitudinal cavity for receiving the penetrator near its center of mass and along its longitudinal axis, a plastic sabot body affixed to the base and projecting forwardly therefrom along the projectile axis, an integral rotating band on the sabot body for imparting to the subcaliber penetrator full spin according to rifling twist and muzzle velocity of the barrel plastic sabot body having integral extension through channels provided within the interfaces between the sabot base segments and extending to the rear of the sabot base and there forming an obturator at the junction with the subcaliber projectile body, having the purpose of securing the sabot base segments to the plastic sabot body as well as forming a seal to prevent propellant gases from entering and escaping through the subcaliber projectile-sabot assembly during launch.

2. A discarding sabot for a fin-stabilized subcaliber projectile to be launched from a rifled barrel at full spin commensurate with the rifling twist and muzzle velocity comprising:

a sabot base sectioned into multiple equal longitudinal segments containing the subcaliber projectile in coaxial position and engaging the projectile body at a common interface providing for the transfer of both longitudinal and rotational accelerations without slippage from the sabot base segments to the subcaliber projectile during launch, said sabot base segments having an exterior contour interlocking and securing sabot body, said sabot body including an integral rotating band at its rear to engage the rifling of the barrel and transfer the spin to the sabot base and subcaliber projectile without slippage, said sabot body including a cylindrical portion of bore diameter forming a bourrelet of sufficient length to prevent balloting during travel in the barrel, said sabot having multiple symmetrically arranged longitudinal grooves extending radially toward the underlying metallic sabot base or subcaliber projectile and leaving a web of finite thickness and strength requiring centrifugal forces caused by full projectile spin to initiate sabot body breakage and subsequent separation at exit from the muzzle, said sabot body having integral extension through channels provided within the interfaces between the sabot base segments and extending to the rear of the sabot base and there forming an obturator at the junction with the subcaliber projectile body, having the purpose of securing the sabot base segments to the plastic sabot body as well as forming a seal to prevent propellant gases from entering and escaping through the subcaliber projectile-sabot assembly during launch, said sabot body at its forward end being provided with a ring groove and a conically shaped hollow plastic cap attached to the groove, with the sabot body and frontal cap protecting the subcaliber projectile from adverse environmental conditions.

3. A discarding sabot for a fin-stabilized subcaliber projectile to be launched from a rifled barrel at full spin commensurate with the rifling twist and muzzle velocity comprising:

a sabot base sectioned into multiple equal longitudinal segments consisting of aluminum alloy containing the subcaliber projectile in coaxial position and engaging the projectile body at a common interface consisting of a screw thread providing for the transfer of both longitudinal and rotational accelerations without slippage from the sabot base segments to the subcaliber projectile during launch, said sabot base segments having an exterior contour interlocking and securing an injection molded plastic sabot body, said plastic sabot body including an integral rotating band at its rear to engage the rifling of the barrel and transfer the spin to the sabot base and subcaliber projectile contained therein coaxially without slippage, said plastic sabot body including a cylindrical portion of bore diameter forming a bourrelet of sufficient length to prevent balloting during travel in the barrel, said sabot having multiple symmetrically arranged longitudinal grooves extending radially toward the underlying metallic sabot base or subcaliber projectile and leaving a web of finite thickness and strength requiring centrifugal forces caused by full projectile spin to initiate sabot body breakage and subsequent separation at exit from the muzzle, said plastic sabot body having integral extension through channels provided within the interfaces between the sabot base segments and extending to the rear of the sabot base and there forming an obturator at the junction with the subcaliber projectile body, having the purpose of securing the aluminum sabot base segments to the plastic sabot body as well as forming a seal to prevent propellant gases from entering and escaping through the subcaliber projectile-sabot assembly during launch, and said plastic sabot body at its forward end being provided with a ring groove and a conically shaped hollow plastic cap attached to the groove.

4. A discarding sabot for a fin-stabilized subcaliber projectile to be launched from a rifled barrel at full spin commensurate with the rifling twist and muzzle velocity comprising:

a sabot base sectioned into multiple equal longitudinal segments consisting of high strength, heat treated aluminum alloy containing the subcaliber projectile in coaxial position and engaging the projectile body at a common interface consisting of a screw thread providing for the transfer of both longitudinal and rotational accelerations without slippage from the sabot base segments to the subcaliber projectile during launch, said sabot base segments having an exterior contour interlocking and securing an injection molded plastic sabot body, said plastic sabot body including an integral rotating band at its rear to engage the rifling of the barrel and transfer the spin to the sabot base and subcaliber projectile contained therein coaxially without slippage, said plastic sabot body including a cylindrical portion of bore diameter forming a bourrelet of sufficient length to prevent balloting during travel in the barrel, said sabot having multiple symmetrically arranged longitudinal grooves extending radially toward the underlying metallic sabot base or subcaliber projectile and leaving a web of finite thickness and strength requiring centrifugal forces caused by full projectile spin to initiate sabot body breakage and subsequent separation at exit from the muzzle, said plastic sabot body having integral extension through channels provided within the interfaces between the sabot base segments and extending to the rear of the sabot base and there forming an obturator at the junction with the subcaliber projectile body, having the purpose of securing the aluminum sabot base segments to the plastic sabot body as well as forming a seal to prevent propellant gases from entering and escaping through the subcaliber projectile-sabot assembly during launch, and said plastic sabot body at its forward end being provided with a ring groove serving for the attachment of a conically shaped hollow plastic cap.

* * * * *